US011578443B2

(12) United States Patent
Noh et al.

(10) Patent No.: US 11,578,443 B2
(45) Date of Patent: Feb. 14, 2023

(54) LAUNDRY TREATING APPARATUS

(71) Applicant: LG ELECTRONICS INC., Seoul (KR)

(72) Inventors: Hyunwoo Noh, Seoul (KR); Jaehyuk Jang, Seoul (KR); Sangwook Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 149 days.

(21) Appl. No.: 16/971,894

(22) PCT Filed: Feb. 20, 2019

(86) PCT No.: PCT/KR2019/002033
§ 371 (c)(1),
(2) Date: Aug. 21, 2020

(87) PCT Pub. No.: WO2019/164240
PCT Pub. Date: Aug. 29, 2019

(65) Prior Publication Data

US 2021/0108360 A1 Apr. 15, 2021

(30) Foreign Application Priority Data

Feb. 22, 2018 (KR) ..... 10-2018-0021234

(51) Int. Cl.
*D06F 25/00* (2006.01)
*D06F 37/26* (2006.01)
(Continued)

(52) U.S. Cl.
CPC ..... *D06F 25/00* (2013.01); *D06F 37/267* (2013.01); *D06F 58/24* (2013.01); *D06F 39/088* (2013.01); *D06F 58/04* (2013.01)

(58) Field of Classification Search
None
See application file for complete search history.

(56) References Cited

U.S. PATENT DOCUMENTS 9,797,080 B2 * 10/2017 Doh ..... B01D 46/79
2015/0176195 A1 5/2015 Joo et al.

FOREIGN PATENT DOCUMENTS

| | | |
|---|---|---|
| KR | 10-0661644 | 12/2006 |
| KR | 10-2006-0089071 | 8/2008 |
| KR | 10-2014-0023634 | 2/2014 |
| KR | 10-1481596 | 1/2015 |

OTHER PUBLICATIONS

PCT International Search Report, dated May 22, 2019, issued in International Application No. PCT/KR2019/002033 (8 pages).

* cited by examine

*Primary Examiner* — Rita P Adhlakha
(74) *Attorney, Agent, or Firm* — Birch, Stewart, Kolasch & Birch, LLP

(57) ABSTRACT

The present disclosure relates to a laundry processing apparatus and, particularly, to a laundry processing apparatus which improves the condensation performance by increasing a contact time and area of cooling water and humid air in a tub. An embodiment of the present disclosure can provide a laundry processing apparatus comprising: a tub in which wash water is stored; a nozzle installed on the upper side of a side part of the tub so as to allow moisture contained in the air staying in the tub to condense, and supplying cooling water; and a guide installed on a rear side surface of the tub to be disposed below the nozzle, and allowing the cooling water supplied from the nozzle to be dispersed in multiple directions and flow downward.

17 Claims, 10 Drawing Sheets

(51) Int. Cl.

| | |
|---|---|
| ***D06F 58/24*** | (2006.01) |
| ***D06F 58/04*** | (2006.01) |
| ***D06F 39/08*** | (2006.01) |

(56) References Cited r

LAUNDRY TREATING APPARATUS

CROSS-REFERENCE TO RELATED APPLICATIONS

This application is a U.S. National Phase entry under 35 U.S.C. § 371 from PCT International Application No. PCT/KR2019/002033, filed Feb. 20, 2019, which claims benefit of priority of Korean Patent Application No. 10-2018-0021234, filed Feb. 22, 2018, the entire contents of all of which are incorporated herein by reference.

TECHNICAL FIELD

The present disclosure relates to a laundry treating apparatus that performs a drying function by supplying separate cooling water to an inner surface of a tub and condensing water in the air by the cooling water flowing along the inner surface of the tub.

BACKGROUND

Generally, examples of a laundry treating apparatus may include a washing machine, a washing machine with a drying function, etc. In this case, the washing machine is a product for removing various contaminants attached to clothes, bedding, etc. by using an emulsion action, a friction action of a water flow based on rotation of a pulsator or drum, and an impact action applied to laundry. An automatic washing machine which has recently appeared automatically performs a series of strokes in the order of a washing course, a rinsing course and a dehydrating course without manipulation of a user in the middle of strokes.

Also, the washing machine with a drying function is a type of a washing machine that may perform the aforementioned function of the washing machine and at the same time dry laundry after washing the laundry. An example of the washing machine with a drying function includes a condensing type washing dryer that takes out the air inside a tub, removes water in the air by condensed water, heats the air and then puts the heated air to the tub.

The condensed type washing dryer is to remove moisture by condensing moisture contained in the wet air through heat exchange with the wet air on an inner surface of a condensed duct by supplying cooling water to the condensed duct. However, since the condensed duct has a relatively small heat exchange area in the inner surface and cooling water should be supplied thereto for a long time, a problem occurs in that the condensed water needs much cooling water.

Therefore, to solve this problem, a system supplying cooling water to an inner surface of a tub by forming a condensed surface where condensed water is condensed on the inner surface in a rear direction of the tub has been introduced. In this case, two nozzles may be provided at an upper portion on the rear surface of the tub and a hose is connected to each of the two nozzles, whereby the cooling water is supplied from each nozzle and flows along a tub surface.

The aforementioned system is applied to condense the cooling water by using a rear portion of the tub of a wide area, whereby the time required for drying and drying performance may be improved.

However, if two nozzles are provided, since the two nozzles should be connected with hoses to respectively supply the cooling water, a water supply structure is complicated, whereby problems occur in that the product cost is increased and an inner structure of the washing machine is complicated.

SUMMARY

Technical Problem

A first object of the present disclosure is to provide a laundry treating apparatus that more efficiently increases a contact time and area of cooling water with the wet air inside a tub to improve condensing performance during drying.

A second object of the present disclosure is to provide a laundry treating apparatus that may control a condensing stroke more stably by more simplifying an inner structure of a washing machine that performs a condensing function and save energy used for condensation of cooling water.

A third object of the present disclosure is to provide a laundry treating apparatus formed in a structure that enables a stable condensing stroke by preventing cooling water from being detached from a path.

In addition to the objects of the present disclosure as mentioned above, additional objects and features of the present disclosure will be clearly understood by those skilled in the art from the following description of the present disclosure.

Technical Solution

To achieve the above objects, a laundry treating apparatus according to the embodiment of the present disclosure comprises a nozzle provided on an upper side of a side portion of a tub, supplying cooling water to condense moisture contained in the air staying in the tub; and a guide provided on a rear side of the tub to be arranged below the nozzle, flowing the cooling water supplied from the nozzle to be dispersed in multiple directions and flow to a lower side.

The nozzle is provided to supply the cooling water from the outside of the tub to the inside of the tub.

In detail, the nozzle may be provided to supply the cooling water toward the rear side inside the tub.

The nozzle may be formed to pass through the tub by adjoining the rear side of the tub. Therefore, the cooling water supplied through the nozzle may flow to a lower direction along the rear side inside the tub.

The nozzle may be formed to be inclined toward the rear side of the tub. Therefore, the cooling water supplied through the nozzle may flow to the lower direction while colliding with the rear side inside the tub.

The guide may be provided to add horizontal moving components from moving components of the cooling water discharged from the nozzle in a vertical lower direction.

The guide may include a peak point arranged in a direct lower direction of the nozzle, and first and second guides extended to be inclined in left and right directions based on the peak point, flowing the cooling water to be dispersed in left and right lower directions.

The first and second guides may be formed in a plate body shape having a flat surface, and the peak point of the guide may be formed to be rounded.

Rear sides of the first and second guides may be formed to be more inclined in a lower direction toward the rear side of the tub than front sides and thus water dropped on the peak point may move to the rear side of the tub.

Cut portions may be formed at the rear sides of the first and second guides to allow the cooling water to flow to a lower side through a space portion formed between the cut portions and the rear side of the tub, and the cut portions may be formed to allow the space portion to be gradually enlarged toward the lower direction.

The first and second guides may be provided with a plurality of through holes through which the cooling water passes. The through holes may be increased toward lower portions of the first and second guides.

End portions of the first and second guides may be formed to be spaced apart from each other at a predetermined distance to allow the cooling water flowing by being dispersed after passing through the guide not to be joined together.

The rear side of the tub may be formed as a continuous surface to allow the cooling water dispersed through the first and second guides to flow along the continuous rear side of the tub.

To achieve the above objects, according to one embodiment of the present disclosure, a laundry treating apparatus comprises a tub in which washing water is stored; a nozzle provided on an upper side of a side portion of the tub, supplying cooling water in a lower direction toward a rear side inside the tub to condense moisture contained in the air staying in the tub; and a guide provided on the rear side inside the tub to be arranged below the nozzle, flowing the cooling water supplied from the nozzle to be dispersed in multiple directions and flow to a lower side.

The guide may include a peak point arranged in a direct lower direction of the nozzle, and first and second guides extended to be inclined in left and right directions based on the peak point, flowing the cooling water to be dispersed in left and right lower directions.

Therefore, the first and second guides may be provided to add horizontal moving components to vertical moving components of the cooling water flowing to a lower portion. The first and second guides may be provided to divide a single water stream into multiple water streams.

The first and second guides may be formed in a plate body shape. That is, the first and second guides may be formed such that their front and rear width and length for flowing the cooling water may be greater than their thickness. The front and rear width of the first and second guides may substantially be a length of the first and second guides protruded from the rear side inside the tub.

The first and second guides may be formed in a plate body shape having a flat surface adjacent to the cooling water.

The first and second guides may be provided to be protruded from the rear side inside the tub to a front direction.

The first and second guides may be formed to have acute angles as angles protruded from the rear side inside the tub to allow the cooling water descending along the first and second guides to be headed for the rear side of the tub. That is, the first and second guides may be protruded to be inclined. In other words, the angle between the rear side of the tub and the first and second guides between the first guide and the second guide may be an obtuse angle. The angle between the first guide and the second guide may be more increased from the rear side of the tub toward the front direction.

The peak point of the guide may be formed to be rounded. Therefore, the cooling water colliding with the peak point by being directly dropped on the peak point may smoothly be divided into left and right directions at the peak point.

The peak point of the guide may be formed to be more inclined in a lower direction toward the rear side of the tub in a rear direction than a front direction and thus the water dropped on the peak point moves to the rear side of the tub. That is, the peak point may be inclined to allow a front portion to be arranged above a rear portion, thereby guiding the cooling water to the rear side of the tub.

This means that horizontal moving components may be provided to the cooling water which is descending and also rear moving components may be provided thereto through the guide. Therefore, the cooling water may be prevented from being directly dropped after being spaced apart from the rear side of the tub in a front direction without flowing along the rear side of the tub.

Cut portions may be formed at rear sides of the first and second guides to allow the cooling water to flow to a lower side through a space portion formed between the cut portions and the rear side of the tub. That is, the cooling water may flow to a direct lower area between the first guide and the second guide through the cut portions. As a result, a contact area between the cooling water and the wet air may be enhanced effectively.

Preferably, the cut portions are formed to allow the space portion to be gradually enlarged toward the lower direction.

The first and second guides may be provided with a plurality of through holes through which the cooling water passes. The cooling water may partially enter the area between the first guide and the second guide through the through holes. Therefore, some of the cooling water may flow to even the direct lower area between the first guide and the second guide. As a result, a contact area between the cooling water and the wet air may be enhanced effectively.

The through holes may be increased toward lower portions of the first and second guides. Preferably, end portions of the first and second guides are formed to be spaced apart from each other at a predetermined distance to allow the cooling water flowing by being dispersed after passing through the guide not to be joined together.

Preferably, the rear side of the tub may be formed as a continuous surface to allow the cooling water dispersed through the first and second guides to continuously flow along the rear side of the tub.

The tub may be inclined to allow a rear portion to be lower than a front portion, the rear side inside the tub may be inclined to allow an upper portion to be arranged more backward than a lower portion, and the nozzle may be provided to supply the cooling water toward the rear side inside the tub in a vertical lower direction.

Preferably, the nozzle is formed to adjoin the rear side inside the tub by passing through an upper portion on an outer circumferential surface of the tub. Therefore, the cooling water discharged from the nozzle may immediately be dropped along the rear side of the tub. The nozzle may discharge the cooling water in a front direction from the rear side inside the tub as much as a predetermined distance. In this case, a discharge direction of the cooling water is preferably headed for the rear side of the tub. It is preferable that this spaced distance is very short. Therefore, it is preferable that the discharge direction of the cooling water is substantially parallel with the rear side of the tub.

Preferably, the nozzle is arranged at a center of left and right sides on the upper portion of the outer circumferential surface of the tub of a cylindrical shape.

Advantageous Effects

The laundry treating apparatus according to the present disclosure improves whole condensing performance and saves drying time and drying energy, which are consumed, by using a structure that cooling water is put from an upper center on a rear surface of a tub in a vertical direction and a structure that the cooling water branches off into two streams.

Also, the laundry treating apparatus according to the present disclosure may control a condensing stroke more stably by more simplifying an inner structure by using only one cooling water nozzle than the case that a plurality of nozzles are used and at the same time make sure of cost competitiveness.

Also, the laundry treating apparatus according to the present disclosure may make sure of reliability of condensing performance by preventing cooling water from being detached from a path by allowing the cooling water to be put along a surface of a tub and allowing the cooling water to flow along the surface of the tub by surface tension.

DETAILED DESCRIPTION

Figure 1:
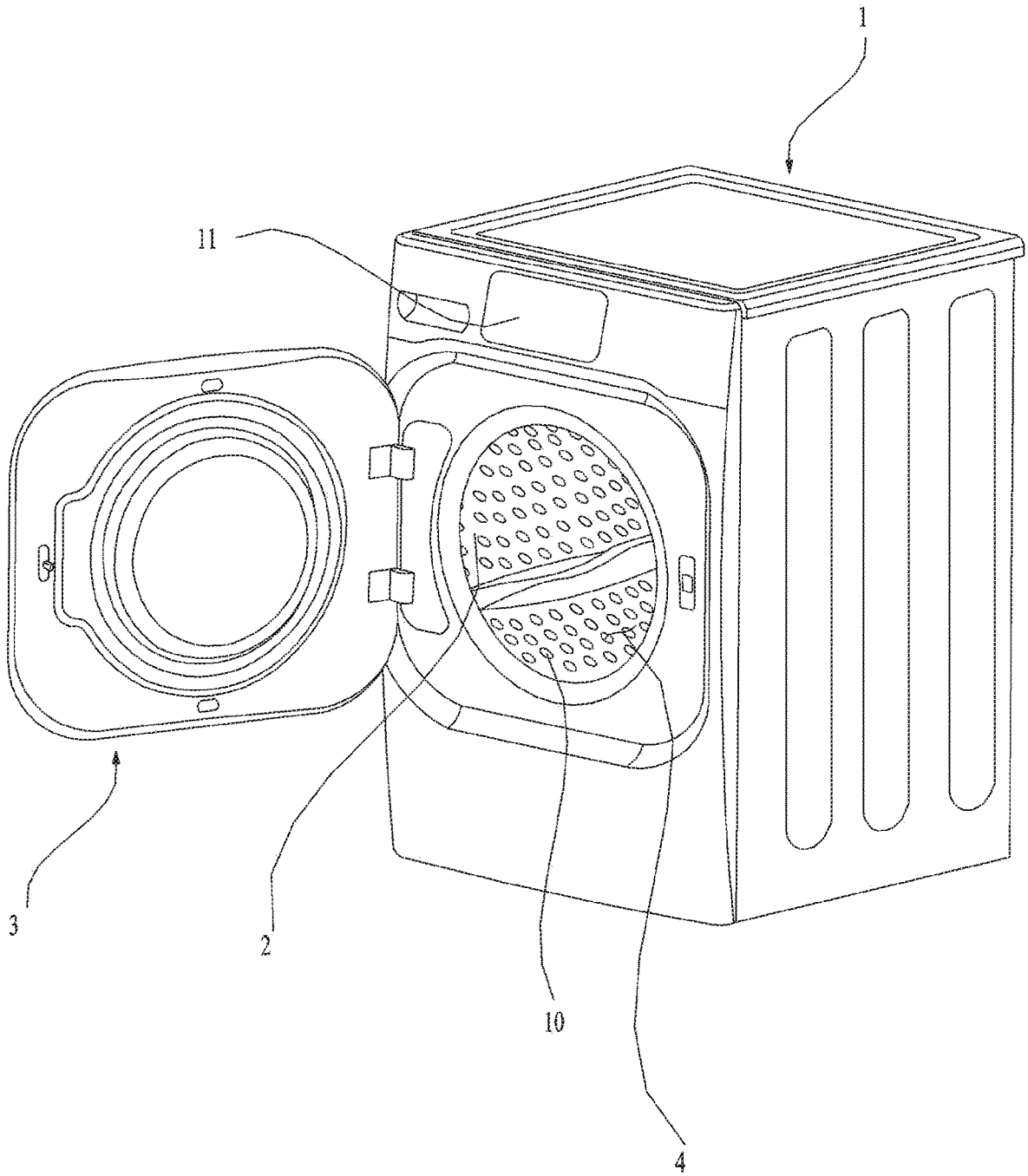
FIG. 1 is a perspective view illustrating an outer structure of a laundry treating apparatus according to the present disclosure.

Hereinafter, the embodiment which will be described is to assist understanding of the present disclosure, and it is to be understood that the present disclosure may be carried out by various modifications from the embodiment described herein. However, in description of the present disclosure, if detailed description of elements or functions known in respect of the present disclosure is determined to make the subject matter of the present disclosure unnecessarily obscure, the detailed description and its detailed drawings will be omitted. Also, the accompanying drawings may be shown exaggeratedly in dimensions of some elements to assist understanding of the present disclosure.

It will be understood that although the terms first, second, etc. may be used herein to describe various elements, these elements should not be limited by these terms. These terms are generally only used to distinguish one element from another.

The terms used herein are intended to describe the embodiments of the present disclosure, and should not be restrictive. It is to be understood that the singular expression used in this specification includes the plural expression unless defined differently on the context. In this description, it is to be understood that the terms such as "include" and "has" are intended to designate that features, numbers, steps, operations, elements, parts, or their combination, which are disclosed in the specification, exist, and are intended not to previously exclude the presence or optional possibility of one or more other features, numbers, steps, operations, elements, parts, or their combinations.

The terms related to a direction which is used in this specification, for example, upper and lower sides, left and right sides, front and rear directions, clockwise and counterclockwise are intended to describe relative arrangements or moving directions of elements shown in the drawings, and should be understood that the other directions should not be excluded.

Hereinafter, one embodiment of the present disclosure will be described with reference to the accompanying drawings.

Figure 2:
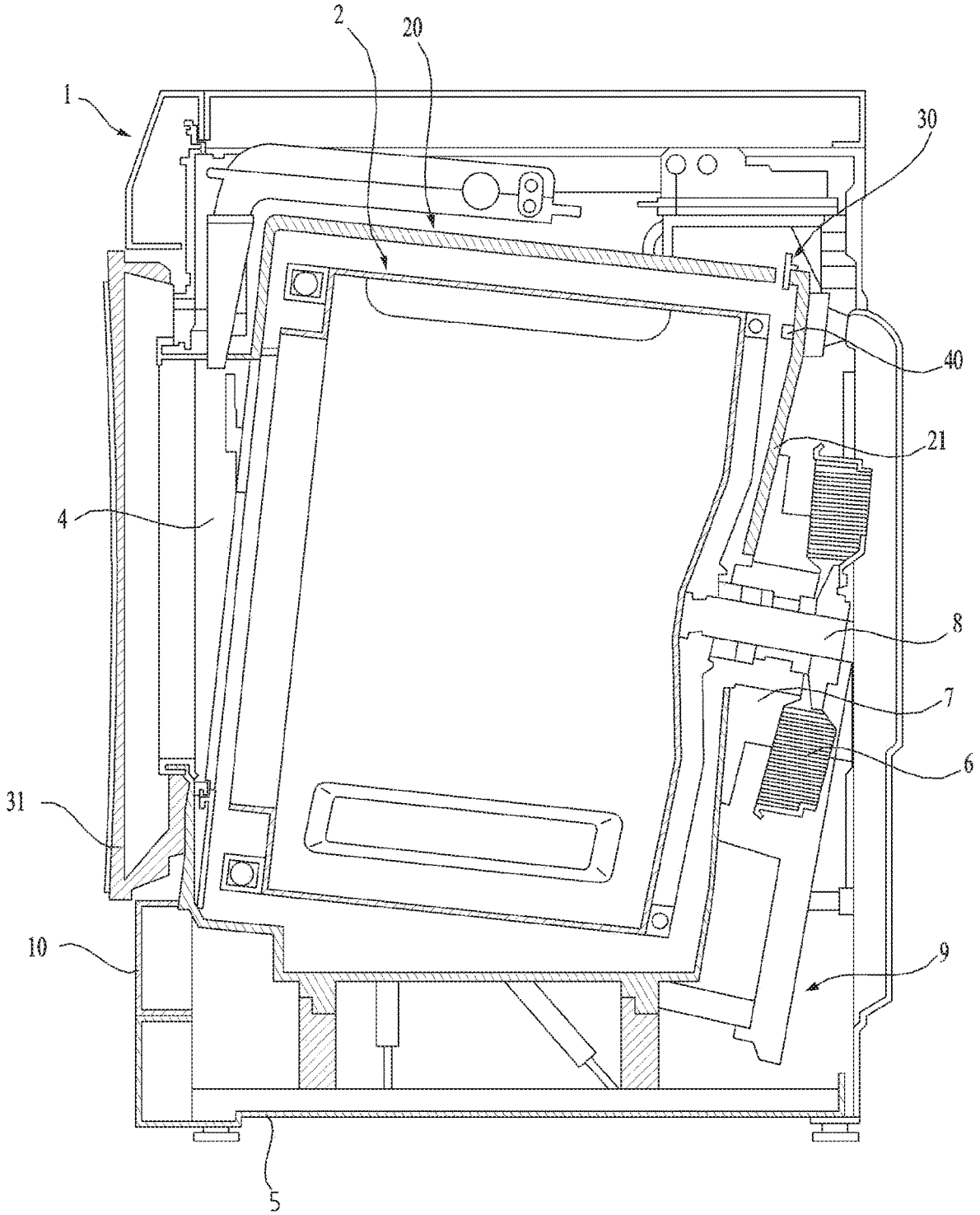
FIG. 2 is a cross-sectional view illustrating a laundry treating apparatus according to the present disclosure.
Figure 3:
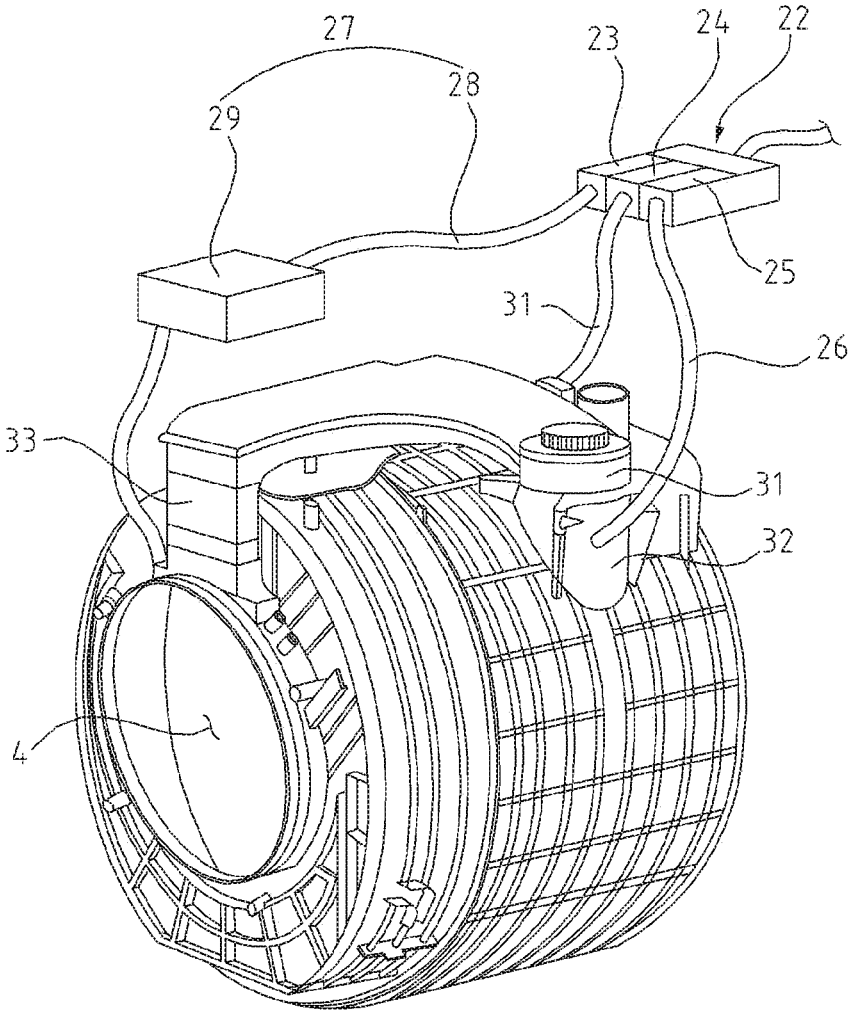
FIG. 3 is a perspective view illustrating a cooling water supply unit and a tub of a laundry treating apparatus according to the present disclosure.

FIG. 1 is a perspective view illustrating an outer structure of a laundry treating apparatus according to the present disclosure. FIG. 2 is a cross-sectional view illustrating a laundry treating apparatus according to the present disclosure. FIG. 3 is a perspective view illustrating a cooling water supply unit and a tub of a laundry treating apparatus according to the present disclosure.

The laundry treating apparatus according to one embodiment of the present disclosure will be described in brief with reference to FIGS. 1 to 3.

The laundry treating apparatus may include a cabinet 1 forming an external appearance, a tub 20 fixedly supported and provided inside the cabinet 1, using an inner surface as a cooling surface for cooling of condensed water, a drum 2 provided inside the tub 20 and rotatably provided, a rotary shaft 8 connected with the drum 2 by passing through the tub 20, rotating the drum 2, a bearing housing 7 supporting the rotary shaft 8, and a driving motor 8 transferring a rotary force to the rotary shaft 8.

The driving motor 6 may be provided at an outer rear wall in a rear direction of the tub, and may be provided in the bearing housing 7.

The laundry treating apparatus may include a suspension unit 9 supporting structures coupled and connected to the baring housing 7 and at the same time mitigating vibration and/or impact. The suspension unit 9 may be configured to be directly connected with the tub not he bearing housing 7.

Also, the cabinet 1 may include a base 5 in which various components are supported and arranged, and a front panel 10 provided with an inlet 4 through which laundry is put. A control panel 11 for controlling an operation of the laundry treating apparatus may be provided above the front panel 10, and a door 3 for opening or closing an opening of the front panel 10 is provided in the opening of the front panel 10.

A water supply unit 27 for supplying water from an external water supply source to the inside of the tub 20 is provided at an upper portion inside the cabinet 1. A drainage unit (not shown) comprised of a drainage hose and a drainage pump is provided at a lower portion inside the cabinet 1 to discharge washing water used for washing and rinsing to the outside.

The tub 20 includes a front tub 21 constituting a front portion and a rear tub 22 constituting a rear portion. The front tub 21 and the rear tub 22 may be assembled by coupling such as a screw, and the drum 2 is accommodated therein. A cooling water supply unit for generating condensed water by using a rear surface of the rear tub 22 may be provided at one side of an outer circumferential surface of the rear tub 22. That is, a cooling water supply unit for generating condensed water using a rear surface inside the rear tub 22 may be provided. That is, the rear surface inside the rear tub 22 serves as a condensing surface by the cooling water supplied from the cooling water supply unit.

Hereinafter, a structure and a process for flowing cooling water into the tub 20 will be described with reference to FIGS. 3 and 4.

A valve unit 22 for selectively or simultaneously supplying water supplied from the external water supply source is provided at an upper portion inside the laundry treating apparatus. In this case, the valve unit 22 may include a plurality of valves corresponding to the respective components to which water should be supplied.

That is, the valve unit 22 includes a water supply valve 23 for controlling supply of washing water or rinsing water to the water supply unit 27, and a cooling water valve 24 for controlling the cooling water supplied to the inner surface of the tub 20 to generate condensed water. If there is any additional element that uses water of the valve unit 22, the valve unit 22 may further include a separate valve. For example, the valve unit 22 may further include a washing water valve 25 for washing the inside of an air recovery hole 32. The washing water valve 25 may be connected with the washing water hose 26 to supply water for washing into the air recovery hole 32.

Meanwhile, the water supply unit 27 includes a water supply hose 28 supplied with washing water from the water supply valve 23, and a detergent supply unit 29 provided on the water supply hose 28 to put a detergent into the tub 20 together with water supplied through the water supply hose 28. In this case, the washing water that has passed through the detergent supply unit 29 is supplied from the front portion of the tub 20 to the inside of the tub 20 through a separate hose.

The cooling water supply unit is intended to dry laundry by generating condensed water on the inner circumferential surface of the tub 20 by using the inner circumferential surface of the tub 20 as a cooling surface, and includes a cooling water hose supplied with cooling water from the cooling water valve 24 and a nozzle 30 arranged at an upper side of a circumferential surface in the rear direction of the tub 20, supplying the cooling water to the rear surface of the tub 20.

The cooling water valve 24 is formed as a solenoid valve. If solenoid is turned on, the valve is opened and therefore the cooling water enters there. If solenoid is turned off, the valve is closed and therefore the cooling water does not enter there. Therefore, the amount of the cooling water may be controlled by on/off of the solenoid valve.

The water flowing from the external water supply source is primarily supplied to the valve unit 22, and is supplied by being diverged to each valve from the valve unit 22. At this time, if an on signal of the solenoid is applied to the cooling water valve 24, the cooling water valve 24 is opened to allow the water enters there. The water that has passed through the cooling water valve 24 flows along the cooling water hose and then is supplied into the tub 20 through the nozzle 30.

Hereinafter, a position and a structure of the cooling water inlet will be described with reference to the accompanying drawings.

Figure 4:
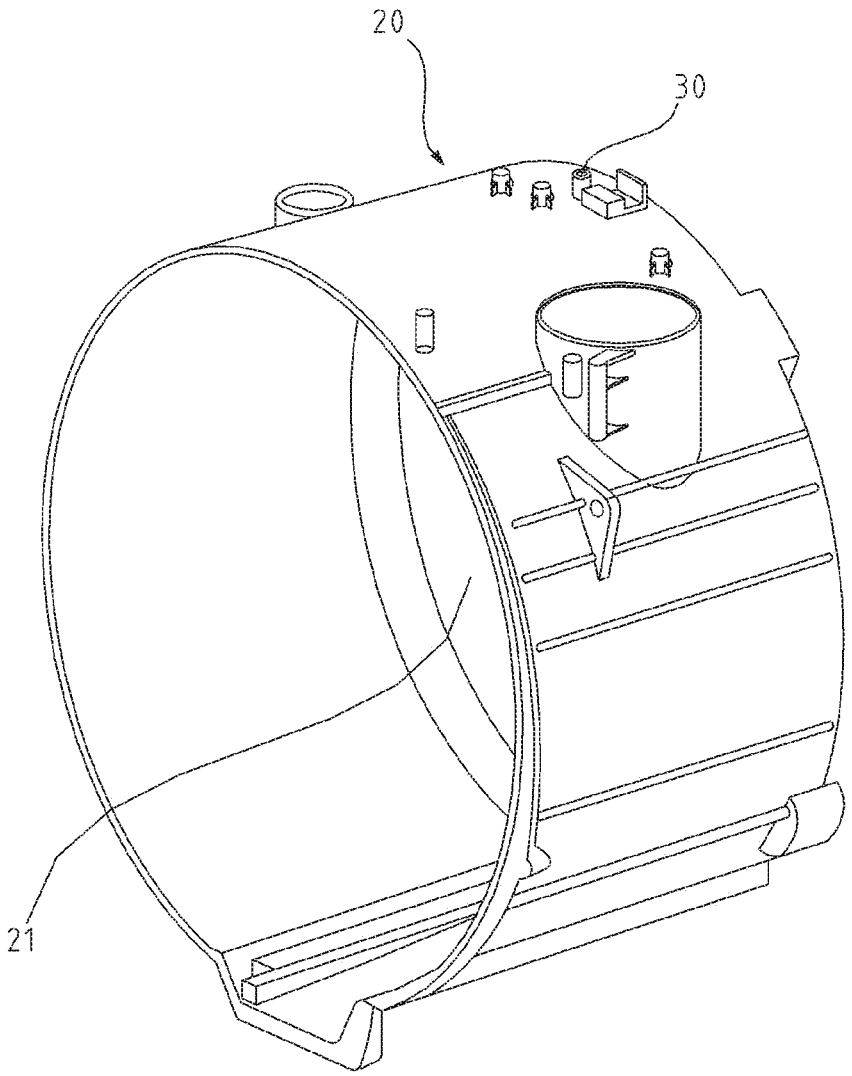
FIG. 4 is a perspective view illustrating an external appearance of a tub and a position of a nozzle.
Figure 5:
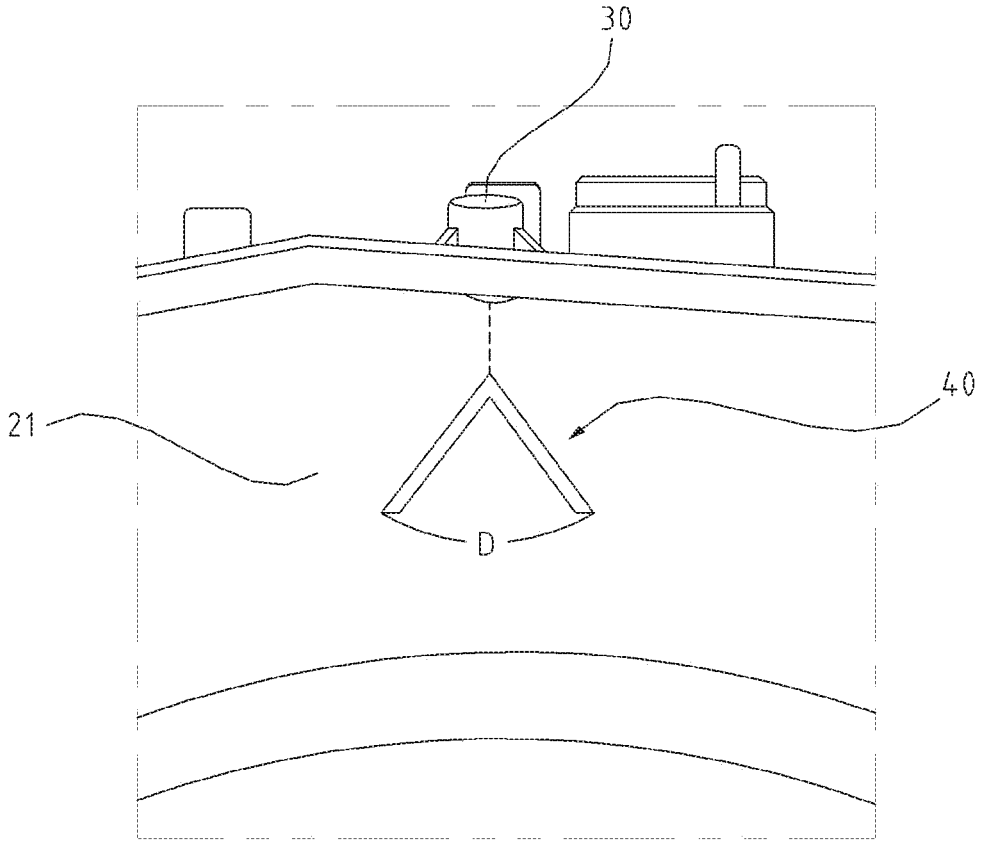
FIG. 5 is a view illustrating positions of a nozzle and a guide.

FIG. 4 is a perspective view illustrating an external appearance of the tub 20 and a position of the nozzle 30. FIG. 5 is a view illustrating positions of the nozzle 30 and the guide 40.

The position and the structure of the cooling water inlet will be described with reference to FIGS. 4 and 5.

The nozzle 30 is provided at an upper side of a side portion of the tub 20 to pass through the tub 20. If the nozzle 30 is provided at the upper side of the tub 20, since a distance of the cooling water that has passed through the nozzle 30 to reach the bottom of the tub 20 is longer than the case that the nozzle 30 is provided at left and right sides, a contact area and a contact time with the air may be increased correspondingly, whereby condensing efficiency may be improved. Therefore, it is preferable that the nozzle is substantially arranged at the uppermost portion of the outer circumferential surface of the cylindrical tub. That is, it is preferable that the nozzle is arranged at the center of left and right sides on the outer circumferential surface of the tub when the tub is viewed from the front direction.

The nozzle 30 may be formed at a portion adjacent to the rear side 21 inside the tub 20. When the cooling water is supplied through the nozzle 30, if the cooling water is directly dropped on the bottom of the tub 20 without passing through the rear surface of the tub 20, the cooling water is directly dropped by gravity except that a resistance of the fine air acts thereon, the contact time with the air inside the tub 20 may be reduced, whereby condensing efficiency may be reduced.

If the cooling water flows along the rear side 21 of the tub, an adhesive force between water and the rear side 21 acts, whereby a drop speed of water is remarkably reduced when comparing the cooling water drops in the air, and thus the contact time with the air may be increased correspondingly.

Also, the rear side 21 of the tub is preferably formed as a continuous surface. That is, the rear side 21 of the tub along which the cooling water flows is preferably provided so as not to exceed 90°. For example, if the cooling water flows along the rear side of the tub formed at 90 degrees, and when the angle of the rear side of the tub exceeds 90 degrees, it deviates from the rear side of the tub and drops vertically. That is, if a discontinuous surface is formed, the cooling water is detached from the rear side of the tub and then vertically dropped. That is, if the rear side 21 of the tub is formed as a discontinuous surface, contact between the rear side of the tub and the cooling water may be released based on the discontinuous surface.

Strong attraction between molecules based on a hydrogen bond exists in water. Therefore, a force for minimizing a surface area acts on a surface of the water, and this is referred to as surface tension. This provides a force that may continue to maintain a path by a force between water molecules if the path is once generated through a water branch flowing along the rear side 21 of the tub. Therefore, the path is formed within a predictable range as far as the surface of the tub 20 is formed as a continuous surface, and the cooling water may flow along the path while maintaining a certain amount of supply, whereby reliability of condensing performance may be obtained.

The amount of the cooling water flowing through the nozzle 30 is controlled through on/off of the solenoid valve. Therefore, if the solenoid valve is turned on, the cooling water enters there, and if the solenoid valve is turned off, the cooling water is prohibited from entering there.

Figure 6A:
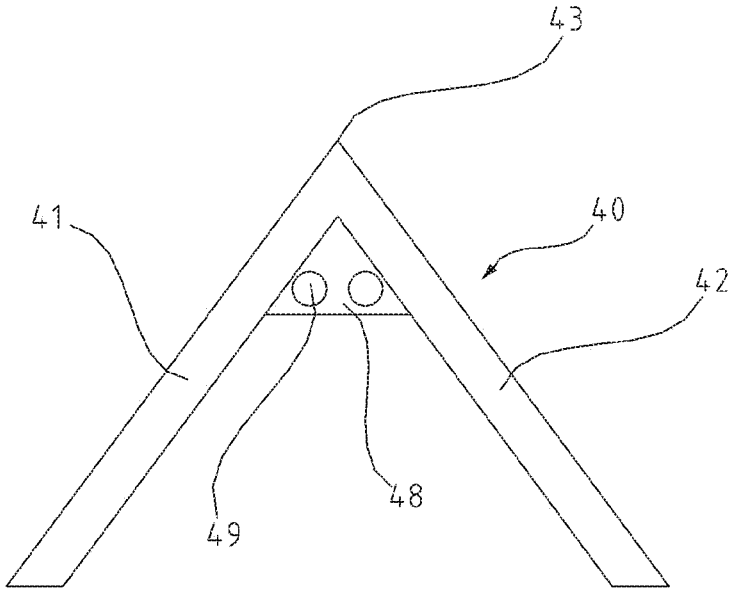
FIG. 6A is a view illustrating that a guide according to the first embodiment of the present disclosure is viewed at a front side.
Figure 6B:
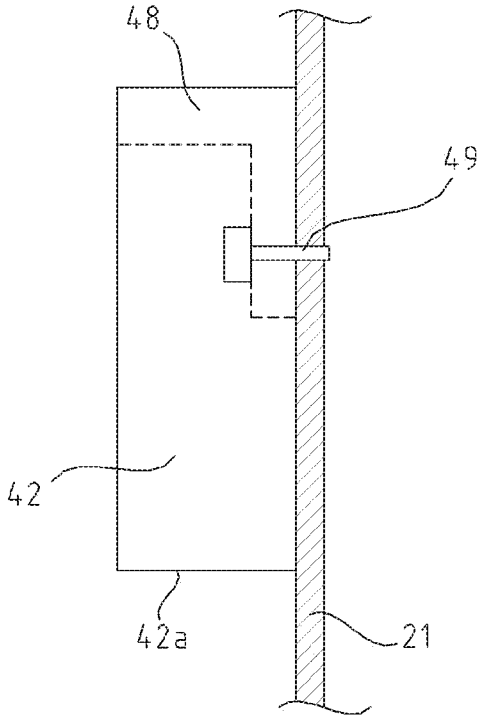
FIG. 6B is a view illustrating that a guide according to the first embodiment of the present disclosure is viewed at a right side.
Figure 6C:
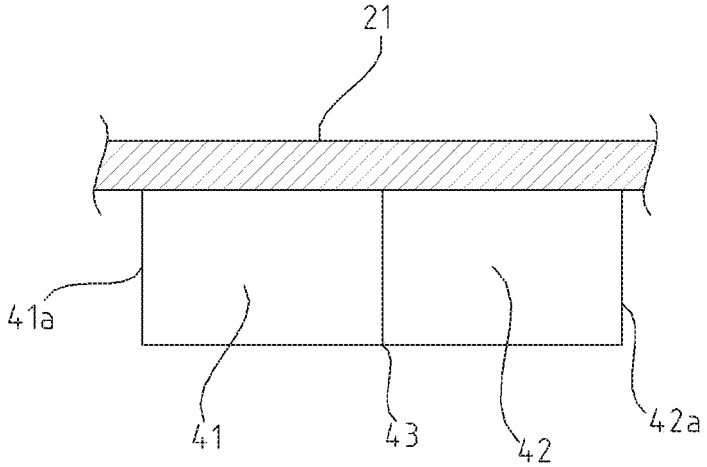
FIG. 6C is a view illustrating that a guide according to the first embodiment of the present disclosure is viewed at an upper side.
Figure 6D:
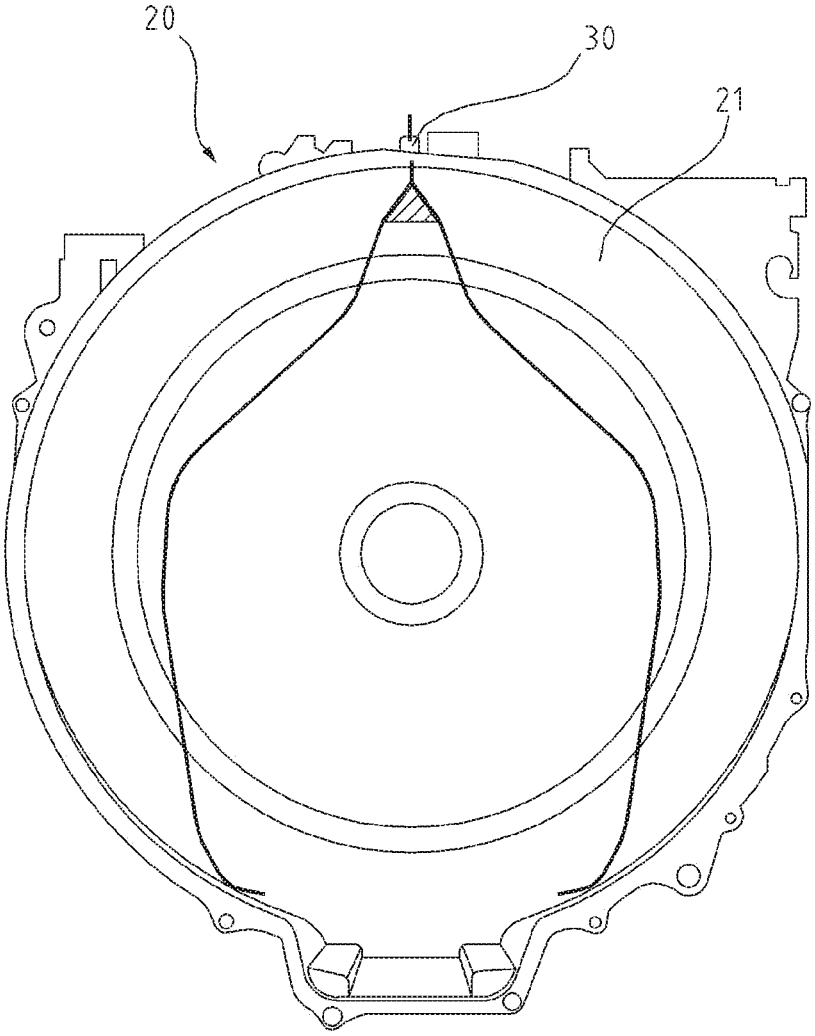
FIG. 6D is a view illustrating that cooling water flows along a tub surface as a water branches off into two streams through a guide in accordance with the first embodiment of the present disclosure.

FIG. 6D is a view illustrating that a water branches off into two streams through a guide in accordance with the first embodiment of the present disclosure. The water branches which are shown substantially indicate a water flow direction at the center of the water branches, and their width may be more enlarged.

Hereinafter, a condensing process of the laundry treating apparatus according to one embodiment of the present disclosure will be described in detail with reference to FIGS. 1 to 5 and FIG. 6D. In this case, the cooling water supply unit may be used during a drying process of the laundry treating apparatus. Therefore, description of a washing stroke and a rinsing stroke of the laundry treating apparatus will be omitted, and the drying process related to one embodiment of the present disclosure will be described.

As the drying process is performed, a ventilating fan 31 of the air supply unit may be operated, and the air inside the tub 20 is sucked through the air recovery hole 32 in accordance with the operation of the ventilating fan 31, and moves to a heating duct (not shown) by the ventilating fan 31. Therefore, the air moving to the heating duct may be heated by a heater provided in the heating duct, and may be supplied into the tub 20 through an air discharge hole 33.

The air supplied into the tub 20 dries laundry inside the drum 2. Therefore, the air that has dried the laundry may be changed to the wet air by moisture evaporated from the laundry and circulated by inflow through the air recovery hole 32.

As the aforementioned process is performed, the air is repeatedly cooled and heated while being circulated. The heated air evaporates water, and is cooled by the cooling water supplied through the cooling water supply unit to remove moisture. First of all, if the cooling water is supplied under the control of the cooling water valve 24, the cooling water moves along the cooling water hose and then is supplied to the rear surface of the tub 20 by the nozzle 30.

The cooling water supplied to the rear surface inside the tub 20 flows along the rear surface of the tub 20 and branches off into two streams through an upper corner 40*a* of the guide 40 and flows along the rear surface of the tub 20 to cool the rear surface of the tub 20. Therefore, the wet air is heat-exchanged with the surface of the tub 20 and the moisture contained in the wet air is condensed on the rear surface of the tub 20 to generate condensed water. Vertically moving components of the cooling water are partially converted to horizontally moving components by the guide 40. Therefore, a length of a path through which the cooling water flows to reach the lowest portion of the tub becomes long and the time when the cooling water flows is increased. As a result, a contact area and a contact time between wet steam and the cooling water are increased.

The cooling water supplied by the cooling water supply unit is discharged to the outside of the laundry treating apparatus through a drainage unit of the tub after cooling the rear surface of the tub 20.

Meanwhile, in one embodiment of the present disclosure, the wet air of a high temperature stays inside the tub 20, and the air of a relatively lower temperature than that of the inside of the tub 20 stays outside the tub 20. Therefore, even though the cooling water is not supplied from the aforementioned cooling water supply unit, condensation may occur on the inner circumferential surface of the tub 20 due to a temperature difference between the inside and the outside of the tub 20.

Even in this case, the amount of condensation may be more increased than the case that a condensing duct according to the related art is used. That is, the condensing duct in the related art induces condensation in an area relatively smaller than that of the inner circumferential surface of the tub 20. However, if condensation is induced in the inner surface of the tub 20 in the same manner as one embodiment of the present disclosure, a cooling surface for condensation is relatively increased than the condensing duct.

Therefore, since a condensing surface relatively wider than that of the related art that uses the condensing duct is formed, condensing efficiency may be increased. Moreover, since the cooling water may be supplied to the rear surface of the tub 20, cooling efficiency may be more increased than the case that the cooling water is not supplied, whereby the cooling water for condensation may be prevented from being consumed.

Also, in methods for supplying the cooling water to the rear surface of the tub 20, a method for providing the nozzle 30 at the center of the upper portion and dispersing a water stream through the guide 40 may be more efficient than the method for providing the nozzle 30 at both sides of the upper portion to supply the cooling water to two places of left and right sides.

If two cooling water nozzles are provided, since two hoses should be provided to be connected to the respective cooling water nozzles and two valves connected with the hoses should be provided, elements based on the two valves should be provided. For this reason, an inner structure of the washing machine may be complicated. Also, there may be a difficulty in that it is required to respectively control whether the cooling water is supplied from each nozzle and the amount of the cooling water from each nozzle.

Also, since each of the two cooling water nozzles should be supplied with the cooling water, the cooling water used for condensation may be more than an expected value. That is, since condensing performance is not improved even in case of the increased amount of the cooling water and the contact time and the contact area of the cooling water with the air act on improvement of condensing performance, the increased use of the cooling water could lead to a waste of the cooling water.

However, if one cooling water nozzle is formed, inflow of the cooling water may be controlled more easily by on/off of a valve for one nozzle. Since one hose is connected with the nozzle, elements and a structure inside the washing machine may be simplified.

Also, as the contact time and the contact area are increased by dispersion of the water stream, even though the cooling water of a proper level is used instead of using a lot of cooling water, condensing performance may be improved correspondingly.

FIG. 6A is a view illustrating that a guide according to the first embodiment of the present disclosure is viewed at a front side. FIG. 6B is a view illustrating that a guide according to the first embodiment of the present disclosure is viewed at a right side. FIG. 6C is a view illustrating that a guide according to the first embodiment of the present disclosure is viewed at an upper side. FIG. 6D is a view illustrating that cooling water flows along a tub surface as a water branches off into two streams through a guide in accordance with the first embodiment of the present disclosure.

Hereinafter, the guide according to the first embodiment of the present disclosure will be described with reference to FIGS. 5 and 6. The guide 40 is provided on the rear side 21 of the tub, and is arranged below the nozzle 30 to disperse the cooling water supplied from the nozzle 30 toward at least two directions. If there is no guide 40, since the water stream of the cooling water is formed as one, there is no option but to perform the condensing process through one water stream. However, if there is the guide 40, since the cooling water supplied from the nozzle 30 is dispersed in at least two directions through the guide 40, the condensing process may be performed by several water streams corresponding to the dispersed directions. Therefore, condensing efficiency may be more enhanced using the same amount of cooling water. Horizontal components may be added to moving components of the cooling water, whereby the moving time and area of the cooling water may be enhanced.

The guide provided in the rear side 21 of the tub may be attached to the rear side of the tub through welding. Also, as shown in FIGS. 6A and 6B, a joint portion 48 of a plate body shape may be formed at a rear portion of the guide 40 and attached to the rear side 21 of the tub by a joint screw 49. A method for providing the guide 40 in the tub 20 is not limited to the aforementioned description, and the guide may be attached to the tub by another method.

End portions 41*a* and 42*a* of first and second guides may be formed to be spaced apart from each other at a predetermined distance D so that the cooling water flowing by being dispersed after passing through the guide may not be joined. When the cooling water flows along the first and second guides 41 and 42 and then is detached from the guides, the respective flow directions of the cooling water may be changed instantaneously. At this time, if the flow directions are toward each other, the dispersed water streams may be joined again.

If the water streams are joined into one, a surface area of the cooling water is reduced correspondingly, whereby the contact area with the air is reduced and condensing performance may be deteriorated. Therefore, the two end portions 41*a* and 42*a* of the first and second guides are formed to be spaced apart from each other at a predetermined distance, whereby the water streams of the cooling water detached from the guide 40 should flow in a state that they are detached from each other.

Meanwhile, the rear side 21 of the tub may be formed to be inclined so that the lower side may slightly be headed for a front direction. That is, the tub may be arranged in a tilting shape. Therefore, the guide 40 vertically provided on the rear side of the tub may also be arranged in a tilting shape. That is, the guide shown in FIG. 6B may be inclined from the rear side 21 of the tub at 3° to 10° in a clockwise direction. As a result, since the guide 40 is formed to be downwardly inclined toward the rear direction, the water dropped to the guide 40 may flow toward the direction of the rear side 21 of the tub.

Also, even though the rear side 21 of the tub is vertically arranged, the guide 40 may be formed to guide the cooling water to the rear side of the tub. Basically, the guide 40 may be formed to be inclined to a left side or a right side to provide the cooling water with horizontal moving components. In addition, the guide 40 may be formed to be inclined from the front direction to the rear direction. In other words, a distance between both ends 41*a* and 42*a* of the guides may be formed to be longer in the front direction than the rear direction of the guides. For example, even though the cooling water is partially dropped at the center portion of front and rear directions of the guides, the cooling water moves to the rear direction by a slope in the first and rear directions of the guides, whereby the cooling water contacts the rear side of the tub. Therefore, the guides may be provided to provide horizontal moving components to the cooling water supplied to a vertical lower direction and at the same time provide rear moving components thereto.

The guide includes a peak point 43 arranged in a direct lower direction of the nozzle 30, and first and second guides 41 and 42 of a plate body shape, which are extended to be inclined in left and right directions based on the peak point and have a flat surface for allowing the cooling water to flow to be dispersed in left and right lower directions The first and second guides 41 and 42 may be formed to be detached from each other to be symmetrical with each other based on a vertical line that passes through the peak point 43 but are not limited thereto.

According to the first embodiment configured as above, the cooling water dropped from the nozzle 30 reaches a portion of the peak point 43 arranged in the direct lower direction of the nozzle 30. The cooling water colliding with the portion of the peak point 43 flows along the surfaces of the first and second guides 41 and 42 from the peak point 43 and is dispersed in left and right directions. That is, the cooling water flows to a lower side of a left direction along the surface of the first guide 41 and also flows to a lower side of a right direction along the surface of the second guide 42.

The first and second guides 41 and 42 are formed to be tightly attached to the rear side of the tub. Therefore, the cooling water may flow to the lower side along the rear side 21 of the tub after reaching the end portions 41*a* and 42*a* of the first and second guides 41 and 42.

Particularly, as the first and second guides 41 and 42 have acute angles not vertical angles as angles protruded from the rear side of the tub, the first and second guides 41 and 42 may guide the cooling water to the rear side of the tub even though the cooling water supplied from the nozzle is partially detached from the front direction of the rear side of the tub.

Figure 7:
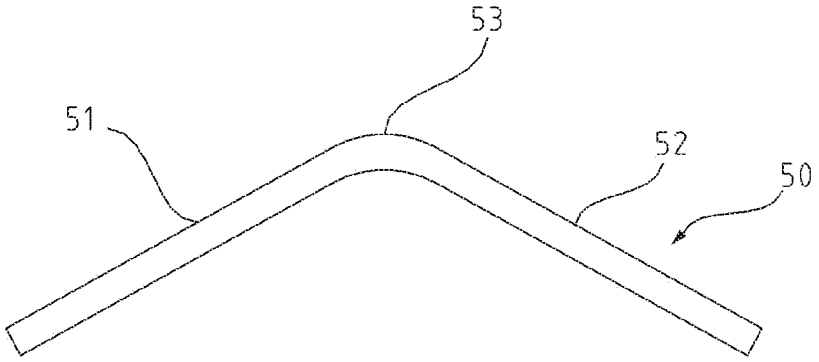
FIG. 7 is a view illustrating that a guide according to the second embodiment of the present disclosure is viewed at a front side.

FIG. 7 is a view illustrating that a guide according to the second embodiment of the present disclosure is viewed at a front side.

Hereinafter, the guide 50 according to the second embodiment of the present disclosure will be described with reference to FIG. 7.

The guide 50 according to the second embodiment of the present disclosure is provided with a peak point 53 which is formed to be rounded. If the peak point 53 is formed to be sharpened, the cooling water dropped from the nozzle 30 may be spurted toward an unexpected direction without flowing along first and second guides 51 and 52 when colliding with the peak point 53.

If the peak point 53 is formed to be rounded, spurt of the cooling water may be reduced, and the cooling water adjacent to the peak point may be arranged in the first and second guides 51 and 52 and stably flow along the guides. The second embodiment may have the same configuration as that of the first embodiment except the aforementioned description.

Figure 8A:
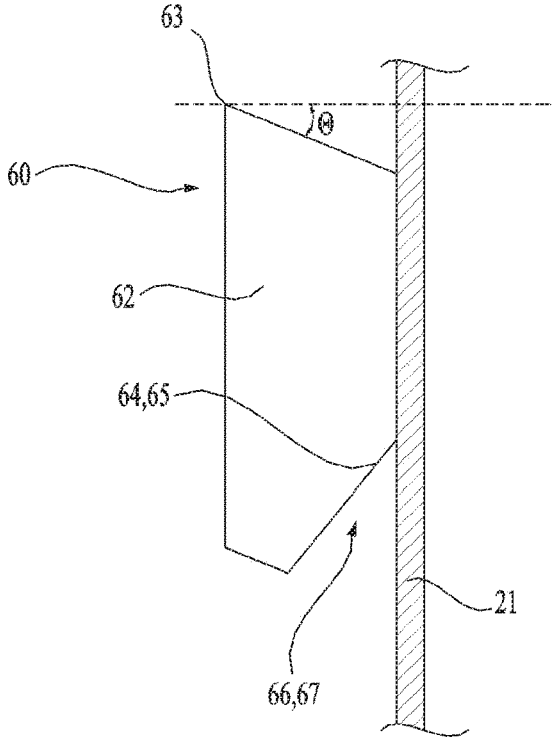
FIG. 8A is a view illustrating that a guide according to the third embodiment of the present disclosure is viewed at a right side.
Figure 8B:
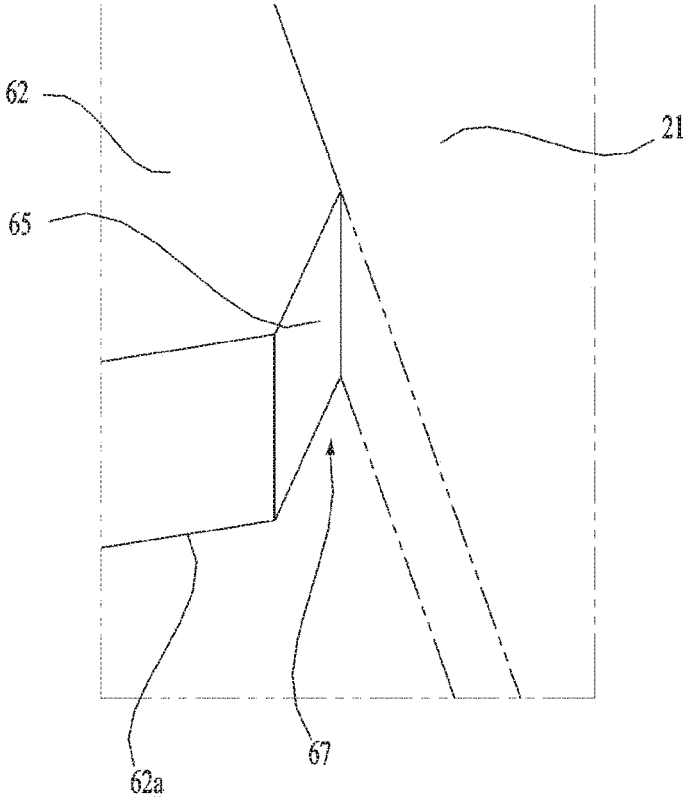
FIG. 8B is a perspective view illustrating that a space portion and a cutting portion of a guide according to the third embodiment of the present disclosure are enlarged.

FIG. 8A is a view illustrating that a guide according to the third embodiment of the present disclosure is viewed at a right side. FIG. 8B is a perspective view illustrating that a space portion and a cutting portion of a guide according to the third embodiment of the present disclosure are enlarged.

Hereinafter, the guide 60 according to the third embodiment of the present disclosure will be described with reference to FIGS. 8A and 8B.

The guide 60 according to the third embodiment of the present disclosure is formed to be more inclined in a lower direction toward the rear side 21 of the tub in a rear side than a front side. This is because that the cooling water supplied from the nozzle 30 may partially flow to a front direction of the tub surface along a peak point 63 without flowing along first and second guides 61 and 62 and then directly drop to the bottom of the tub surface after reaching the peak point 63. In this way, some of the cooling water which does not flow along the tub surface may be lost, whereby condensing performance may be deteriorated.

Therefore, the cooling water that has reached the front side of the tub surface through the rear side of the guide formed in a lower direction may move to the rear side of the tub and at the same time flow to the lower direction along the first and second guides 61 and 62. That is, in this embodiment, a shape and an angle of the peak point 63 may be provided to provide rear moving components of the cooling water.

This embodiment may have the same configuration as that of the first embodiment of the present disclosure except the aforementioned description. Therefore, even in this embodiment, the first and second guides as well as the peak point 63 may be provided to provide rear moving components of the cooling water.

Meanwhile, cut portions 64 and 65 may respectively be formed at the rear side of the lower portion of the first and second guides 61 and 62, whereby the cut portions 64 and 65 and the first and second guides 61 and 62 may extend from the peak point 63 in close contact with the rear side 21 in the left and right downward directions. The cut portion 64 and 65 may form space portion 66 and 67 with the rear side 21 of the tub. Specifically, the cut portion 64 and 65 may be spaced apart from the rear side 21 of the tub by a predetermined distance from the lower portion of the first and second guide portions 61 and 62 to form a space portion 66 and 67.

The cut portions 64 and 65 may be extended to a lower side while forming a predetermined angle with the rear side 21 of the tub, and the space portions 66 and 67 formed through the cut portions may also be formed such that the space formed with the rear side 21 of the tub is gradually enlarged toward the lower direction.

Since the space portions 66 and 67 are formed with a small area at the upper side and then formed with a greater area toward the lower side, water which does not flow through the upper side of the cut portions may flow through the lower side of the cut portion cut with a greater range, whereby the cooling water may flow while being dispersed in left and right directions at a length or more of the cut portion. Therefore, since the cooling water flows along the rear side 21 of the tub of a wider area, condensing performance is improved. The aforementioned cut portion and the shape of the space portion formed by the cut portion may be applied to the first embodiment and the second embodiment.

Figure 9:
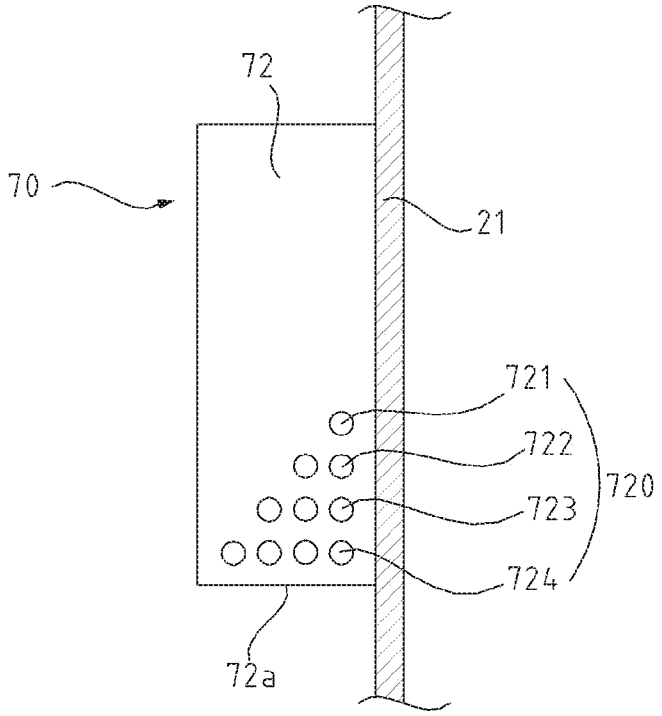
FIG. 9 is a view illustrating that a guide according to the fourth embodiment of the present disclosure is viewed at a right side.

FIG. 9 is a view illustrating that a guide according to the fourth embodiment of the present disclosure is viewed at a right side.

Hereinafter, the guide 70 according to the fourth embodiment of the present disclosure will be described with reference to FIG. 9.

The guide 70 according to the fourth embodiment of the present disclosure is provided with a plurality of through holes 710 and 720 formed at first and second guides 71 and 72. At this time, the number of the through holes may be increased toward lower portions of the first and second guides 71 and 72.

The cooling water flowing along the first and second guides 71 and 72 may be discharged out through the through holes 710 and 720, and then may flow to the lower side of the guides. At this time, the cooling water that is not discharged through the through holes formed at the upper sides of the first and second guides 71 and 72 may flow to the lower side of the guide through the through holes arranged at the lower sides of the first and second guides.

At this time, the number of through holes arranged at the lower sides of the first and second guides may be increased, whereby the cooling water that is not discharged through the through holes at the upper sides may be discharged through the through holes at the lower sides. Also, the cooling water that is not discharged through the upper and lower through holes may flow to the lower side of the guide 70 after passing through cooling water end portions 71*a* and 72*a*.

The through holes may enlarge a moving area of the cooling water to the inner areas of the guides as well as outer areas in left and right directions of the guide. Preferably, an angle between the first guide and the second guide may be provided with a sufficiently great size, whereby two water streams may not meet each other in the inner area between the first guide and the second guide.

The through holes may be enlarged in the form of slit.

This embodiment may have the same configuration as that of the first embodiment except the aforementioned description.

The accompanying drawings are only intended to facilitate understanding of the embodiments disclosed in this specification, and it is to be understood that technical spirits disclosed in this specification are not limited by the accompanying drawings and the accompanying drawings include all modifications, equivalents or replacements included in technical spirits and technical scope of the present disclosure.

The preferred embodiments of the present disclosure have been described in detail above to allow those skilled in the art to implement and practice the present disclosure. Although the preferred embodiments of the present disclosure have been described above, those skilled in the art will appreciate that various modifications and variations can be made in the present disclosure without departing from the spirit or scope of the disclosure. For example, those skilled in the art may use a combination of elements set forth in the above-described embodiments. Thus, the present disclosure is not intended to be limited to the embodiments described herein, but is intended to accord with the widest scope corresponding to the principles and novel features disclosed herein.

INDUSTRIAL APPLICABILITY

Industrial applicability is described in the detailed description of the present disclosure.

What is claimed is:

1. A laundry treating apparatus comprising:

a tub in which washing water is stored;

a nozzle provided on an upper side of a side of the tub, supplying cooling water in a lower direction toward a rear side inside the tub to condense moisture contained in the air staying in the tub; and a guide provided on the rear side inside the tub to be arranged below the nozzle, flowing the cooling water supplied from the nozzle to be dispersed in multiple directions and flow to a lower side, the guide including a peak point arranged below the nozzle, and first and second guides extending to be inclined in left and right directions based on the peak point, and flowing the cooling water to be dispersed in left and right lower directions.

2. The laundry treating apparatus of claim 1, wherein the first and second guides are formed in a plate body shape.

3. The laundry treating apparatus of claim 2, wherein the first and second guides are formed in a plate body shape having a flat surface adjacent to the cooling water.

4. The laundry treating apparatus of claim 2, wherein the first and second guides are provided to be protruded from the rear side inside the tub to a front direction.

5. The laundry treating apparatus of claim 4, wherein the first and second guides have acute angles as angles protruded from the rear side inside the tub to allow the cooling water descending along the first and second guides to be headed for the rear side of the tub.

6. The laundry treating apparatus of claim 1, wherein the peak point of the guide is formed to be rounded.

7. The laundry treating apparatus of claim 1, wherein the peak point of the guide is formed to be more inclined in a lower direction toward the rear side of the tub in a rear direction than a front direction and thus the water dropped on the peak point moves to the rear side of the tub.

8. The laundry treating apparatus of claim 7, wherein the through holes are increased toward lower portions of the first and second guides.

9. The laundry treating apparatus of claim 1, wherein cut portions are formed at rear sides of the first and second guides to allow the cooling water to flow to a lower side through a space portion formed between the cut portions and the rear side of the tub.

10. The laundry treating apparatus of claim 9, wherein the cut portions are formed to allow the space portion to be gradually enlarged toward the lower direction.

11. The laundry treating apparatus of claim 1, wherein the first and second guides are provided with a plurality of through holes through which the cooling water passes.

12. The laundry treating apparatus of claim 1, wherein end portions of the first and second guides are formed to be spaced apart from each other at a predetermined distance to allow the cooling water flowing by being dispersed after passing through the guide not to be joined together.

13. The laundry treating apparatus of claim 1, wherein the rear side of the tub is formed as a continuous surface to allow the cooling water dispersed through the first and second guides to continuously flow along the rear side of the tub.

14. The laundry treating apparatus of claim 1, wherein the tub is inclined to allow a rear portion to be lower than a front portion, the rear side inside the tub is inclined to allow an upper portion to be arranged more backward than a lower portion, and the nozzle is provided to supply the cooling water toward the rear side inside the tub in a vertical lower direction.

15. The laundry treating apparatus of claim 14, wherein the nozzle is formed to adjoin the rear side inside the tub by passing through an upper portion on an outer circumferential surface of the tub.

16. The laundry treating apparatus of claim 1, wherein the nozzle is arranged at a center of left and right sides on an upper portion of an outer circumferential surface of the tub of a cylindrical shape.

17. The laundry treating apparatus of claim 1, wherein the peak point of the guide is spaced apart from the nozzle.

* * * * *